US006561403B1

(12) United States Patent
Kannankeril et al.

(10) Patent No.: US 6,561,403 B1
(45) **Date of Patent: *May 13, 2003**

(54) BAG SEPARATOR AND DISPENSER

(75) Inventors: Charles P. Kannankeril, North Caldwell, NJ (US); Adrian G. Gerritsen, Wayne, NJ (US)

(73) Assignee: Cryovac, Inc., Duncan, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/963,885

(22) Filed: Nov. 4, 1997

Related U.S. Application Data

(63) Continuation of application No. 08/563,279, filed on Nov. 22, 1995, now abandoned.

(51) Int. Cl.[7] ..... B26F 3/02; B65H 35/10

(52) U.S. Cl. ..... 225/96; 225/51; 225/106; 242/422.5

(58) Field of Search ..... 225/96, 51, 33, 225/91, 39, 47, 106; 242/423.2, 570, 598, 598.3, 598.4, 598.5, 598.6, 599.3, 422.5, 422.6; 221/259

(56) References Cited

U.S. PATENT DOCUMENTS

| | | | | |
|---|---|---|---|---|
| 1,122,674 A | 12/1914 | Winter et al. | ..... | 225/51 |
| 1,434,040 A | 10/1922 | Bullock | ..... | 225/33 |
| 1,912,363 A | 6/1933 | De Waide | ..... | 225/106 |
| 2,304,312 A | 12/1942 | Meglitz | ..... | 225/47 |
| 2,414,915 A | 1/1947 | Ziegler | ..... | 225/47 |

(List continued on next page.)

FOREIGN PATENT DOCUMENTS

| | | |
|---|---|---|
| DE | 1561931 | 4/1970 |
| EP | 0528 670 A1 | 8/1991 |
| WO | 96/03338 | 6/1995 |

*Primary Examiner*—Charles Goodman
(74) *Attorney, Agent, or Firm*—Rupert B. Hurley, Jr.

(57) ABSTRACT

A bag dispenser, for separating and dispensing plastic bags from a roll of bags where one end is attached to the top of the next bag by perforation lines with a slot therebetween. The bags are dispensed from a device comprising a wire frame formed into arcuate channels to support the core that the series of bags are rolled onto. The dispenser includes a second tensioning member attached to a support member and disposed at an angle thereto to provide tension to the edges of the roll of bags as the core passes through the channel passageway as bags are removed from the roll. Spaced apart from the support is a symmetric separating tongue. The tongue will engage the slot regardless of whether the bags are drawn over or under the tongue. As the user pulls on the bags, a tension is created by the brake and the user to deflect the tongue which remains deflected until the tongue engages the slot. Thus, when the separator engages the slot, the tongue recoils through its normal position to facilitate the separation of the two bags. The dispenser may also include core retaining members located at the closed end of the arcuate channels to keep the core of smaller rolls from popping out and to retard rotation of the core.

22 Claims, 2 Drawing Sheets

U.S. PATENT DOCUMENTS

| | | | | | |
|---|---|---|---|---|---|
| 2,452,299 | A | | 10/1948 | Gould | 225/47 |
| 3,062,424 | A | | 11/1962 | Stirrup | 225/47 |
| 3,494,518 | A | | 2/1970 | Goss | 225/46 |
| 3,702,672 | A | | 11/1972 | Becht | 225/106 |
| 3,770,222 | A | | 11/1973 | Jespersen | 242/55.3 |
| 4,454,974 | A | | 6/1984 | Cooke | 225/106 |
| 4,771,966 | A | | 9/1988 | Anderson | 225/51 |
| 5,118,022 | A | | 6/1992 | Farahnik | 225/106 |
| 5,135,146 | A | | 8/1992 | Simhaee | 225/80 |
| 5,170,957 | A | | 12/1992 | Carpenter | |
| 5,207,368 | A | | 5/1993 | Wilfong, Jr. et al. | 225/106 |
| 5,209,371 | A | | 5/1993 | Daniels | 221/63 |
| 5,219,424 | A | | 6/1993 | Simhaee | 225/47 |
| 5,261,585 | A | | 11/1993 | Simhaee | 225/47 |
| 5,307,969 | A | | 5/1994 | Menendez | 225/42 |
| 5,556,019 | A | * | 9/1996 | Morris | 225/96 |
| 5,636,809 | A | * | 6/1997 | Koch | 242/598.3 X |
| 5,934,535 | A | * | 8/1999 | Kannankeril et al. | 225/106 |

* cited by examiner

BAG SEPARATOR AND DISPENSER

This application is a continuation of application Ser. No. 08/563,279, filed Nov. 22, 1995 now abandoned.

BACKGROUND OF THE INVENTION

1. Field of the Invention

The present invention relates generally to devices for dispensing bags. More specifically, the present invention relates to plastic bag dispensers where each bag is separated from a roll of bags.

2. Description of the Prior Art

In supermarkets and other types of food markets, fruits, vegetables, and other produce are displayed in bulk, on tables or in open coolers. Plastic bags are provided for consumers who want them for their produce selections. The most common way to dispense these produce bags is on cylindrical rolls mounted horizontally or vertically. The top of each bag is attached to the bottom of the next bag. Each bag may be separated from the next along a perforated line that defines the end of one bag and the start of the next bag. By grabbing a bag with one hand and the next bag with the other hand, and then pulling, the consumer can separate the two bags along the perforation line. Sometimes consumers will tear or stretch the bags when trying to separate them or attempt to simply jerk the bag from the roll causing it to unravel. Additionally, after a bag has been taken from the roll, the next bag may lie flat on the surface of the roll, making it very difficult to find or peel from the roll. Moreover, removing bags from a roll of bags is a two-handed task.

Simhaee, in U.S. Pat. No. 5,261,585, discloses a plastic bag dispenser that attempts to overcome some of the problems inherent in existing dispensers by enabling the consumer to tear the bags with one hand without the bags unraveling by pulling the bags horizontally across a single finger and downwardly to separate the bags. This type of bag dispenser does not include a tensioning member to prevent the rolls of bags from unraveling as the roll reaches a smaller diameter. This type of bag dispenser must be carefully mounted to surfaces so that they are properly oriented for dispensing bags.

Yet another bag dispenser is shown in application Ser. No. 08/279,912, filed Jul. 25, 1994 now U.S. Pat. No. 5,556,019 to Morris, which discloses a wire frame bag dispensesr having tensioning fingers along the core holding channels to retard the removal of bags from a roll. However, the tension provided by the fingers deters the core from easily descending through the channels as the roll gets smaller. A further problem with existing bag dispensers is that ink transfer from the printed bags to the dispenser body often occurs. Thus, there is a need to provide a bag dispenser that is easy to clean and maintain. Therefore, there is still a need to develop a bag dispenser that operates smoothly, is easy to use, can be easily mounted in various orientations, has a reliable brake for rolls as the diameter of the roll gets smaller, and is designed so that the smaller size rolls will not pop out of the channels when a bag is removed by, for example, jerking the bag.

SUMMARY OF THE INVENTION

The present invention is a plastic bag dispenser. The bag dispenser holds a series of bags where one bag is connected at its bottom end to the top of the next bag, but where a line of perforations and a slot facilitate separation of the bags.

Additionally, the series of bags is rolled onto a core, so that they may be supported and dispensed as the bags are unrolled. The perforations may be a row of small holes or short slits. The slot is a larger slit in the line of perforations. The perforations and slot define the end of one bag and the start of the next bag. The dispenser is-for use with such bags or other articles that are similarly joined.

The bag dispenser comprises a support member for mounting the dispenser to a surface, a pair of arcuate guide channels, two distinct tensioning members, and a tongue for separating one bag from another. The support member is preferably a metal plate. The pair of arcuate guide channels are formed of a metallic wire and are designed to support the core so that it can rotate freely in place in the channels. The arcuate channels are spaced from but attached to the support member by brackets.

In a preferred embodiment, a tensioning member is positioned to apply tension to the outer edges of the circumference of the roll of bags as the bags are removed from the roll. The tensioning member or brake is attached to the support member and positioned at an angle to the support member so as to contact the edges of the circumference of the roll thereby providing tension against the roll of bags to retard rotation of the roll. Therefore, the weight of the roll increases friction of the next bag being pulled between the roll and the brake.

In an alternative embodiment, the channels of the bag dispenser include core retaining outer bar members which form a part of each channel. The core retaining members help to keep the core within the channels and not pop out as the diameter of the roll of bags gets smaller, and serves to retard the rotation of the roll of bags as the roll diminishes in diameter so that the roll does not unravel if pulled too hard. The core retaining members are preferably attached to the outside of each channel toward their closed ends and are positioned so that they contact the ends of the core. As the bags are removed from the roll, the weight of the roll decreases and, thus, the amount of tension the brake provides to the bags decreases as well. However, in this embodiment, as the core descends within the channels, the core's ends come into engagement with the outer bar members on each side adding friction to the core retarding its rotation and subsequent unraveling at the bags. This increase in friction provided by the outer bar members also helps maintain a sufficient and relatively consistent tension in the series of bags so that the bracket supporting the tongue will deflect.

The dispenser is provided with a tongue for separating the bags from each other. The tongue is spaced apart from and carried by the support member. The tongue is preferably diamond shaped, angled toward the series of bags and is designed to engage the slot between each bag to separate each bag from the next bag. The tongue is attached via a first support bracket which is in turn attached or possibly made integral to a second bracket which is, in turn, attached to the support member.

An important feature of this invention is the two-sided tongue carried by the bracket. By having a two-sided tongue, the slot in the perforation between bags will engage the tongue regardless of whether a bag is pulled across the top or the bottom of the tongue. This feature allows the bag dispenser to be mounted in a variety of positions and allows the user to easily pull the bag over or under the tongue to separate the bag.

Another feature of the present invention is the bracket to which the tongue is attached. As the user pulls the bag over or under the tongue, the tension caused by pulling a bag over the tongue and the retarded roll of bags causes the bracket to deflect. This deflection continues until the tongue engages the slot, at which point the carriage and tongue recoil from the deflected position through their normal position to facilitate the separation of the two bags by the "snap" of the recoil.

Other objects, features and advantages of the present invention will be apparent as the description proceeds when taken in conjunction with the accompanying drawings.

DETAILED DESCRIPTION OF A PREFERRED EMBODIMENT

Figure 1:
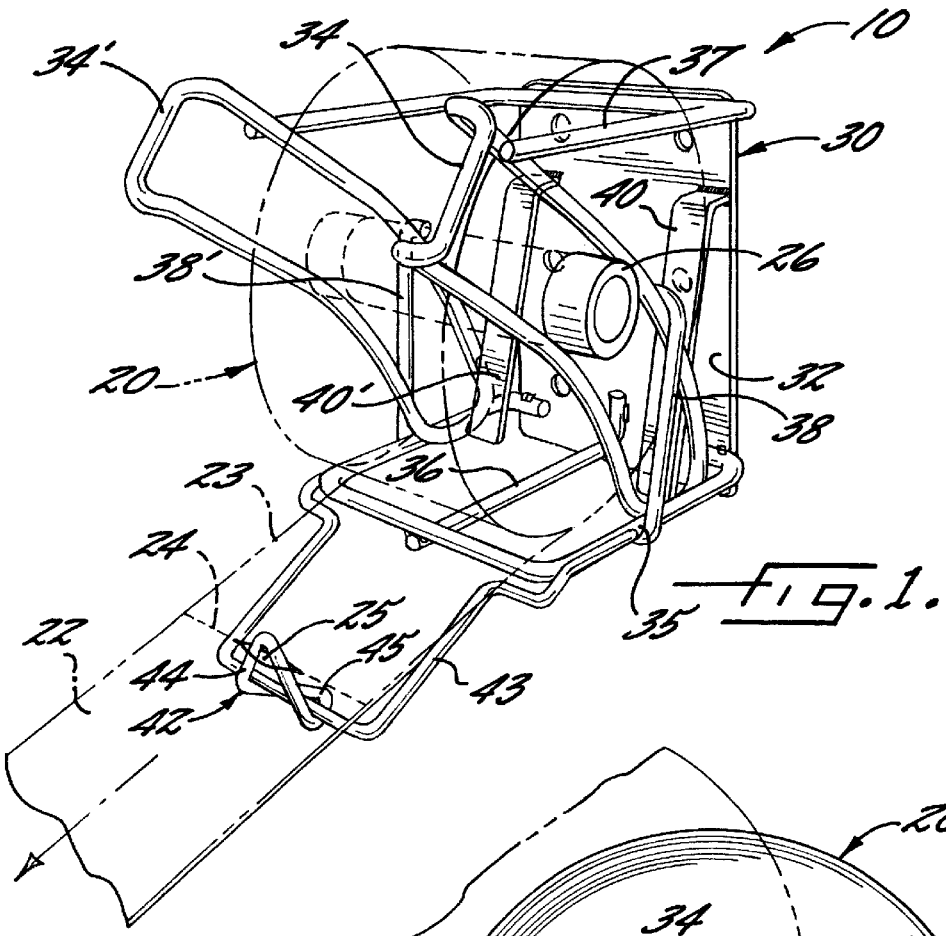
FIG. 1 is a perspective view of the bag dispenser according to the present invention.

Referring now more specifically to the drawings, there is shown in FIG. 1 the bag dispensing system 10 embodying the features of the present invention. As illustrated, the bag dispensing system 10 includes a roll of plastic bags 20 and a dispenser 30. The roll of plastic bags 20 includes the end of a first bag 22 connected to the top of a next bag 23 and separated by a perforated tear line 24 including a slot 25 located in a predetermined position within the perforated tear line 24, preferably at or near the midpoint between the sides of the bag. The bags are rolled onto a core 26 to form a roll. The bag in the open position, i.e., when in use, may vary in width but is preferably about 12 inches. The bag is folded to a width of about 3 to about 4 inches when rolled onto the core 26. The slot 25 extends through each of the folds.

Bag dispenser 30 includes a support member 32, a pair of arcuate guide channels 34, 34', each having outer bar members 38, 38', a tensioning member, brake 40, 40' and a tongue 42. Bag dispenser 30 includes a support member 32 for attachment to a support surface such as a wall or countertop. The support member 32 is a thin metal plate with a plurality of holes 33 suitable for attaching the bag dispenser 30 to a variety of surfaces.

Figure 2:
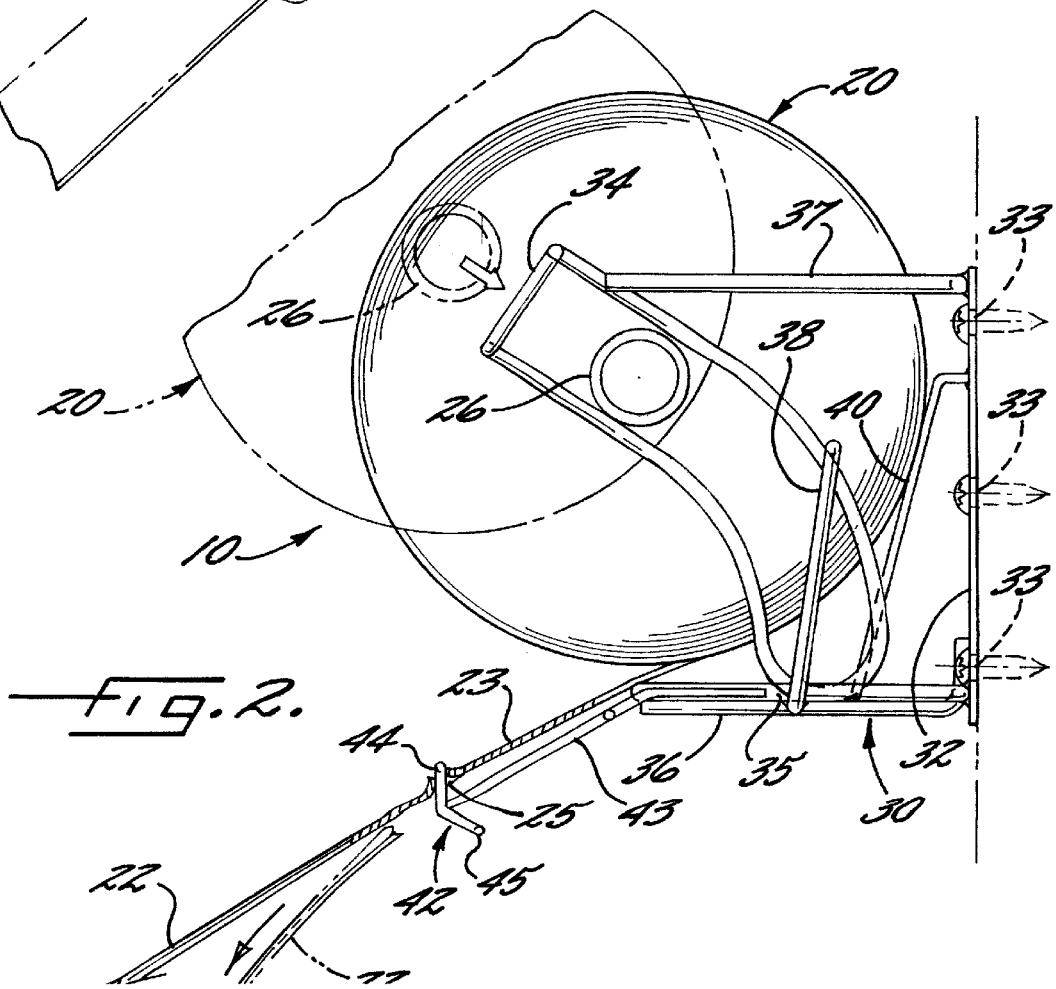
FIG. 2 is a side view of the bag dispenser according to the present invention.

A pair of arcuate channels 34, 34' are formed of wire frames. In a preferred embodiment, the channels are formed of a U-shaped wire or rod frame extending outwardly in an arc as shown most clearly in FIG. 2. The channels 34, 34' are attached at their closed end to wire bracket 35 which is attached perpendicular to support member 32. Wire bracket 35 may be reinforced by brace 36 having one end attached to the front of bracket 35 and the other end attached to support member 32. The channels 34, 34' are supported at their outer end by attachment to support bracket 37. The radius of the arc of the channels 34, 34' is determined by the ever decreasing radius of the roll of bags being dispensed such that the outer circumference of the roll of bags is in contact with tensioning member, brake 40, 40'. Channels 34, 34' are dimensioned to allow core 26 to rotate freely in place.

Figure 3:
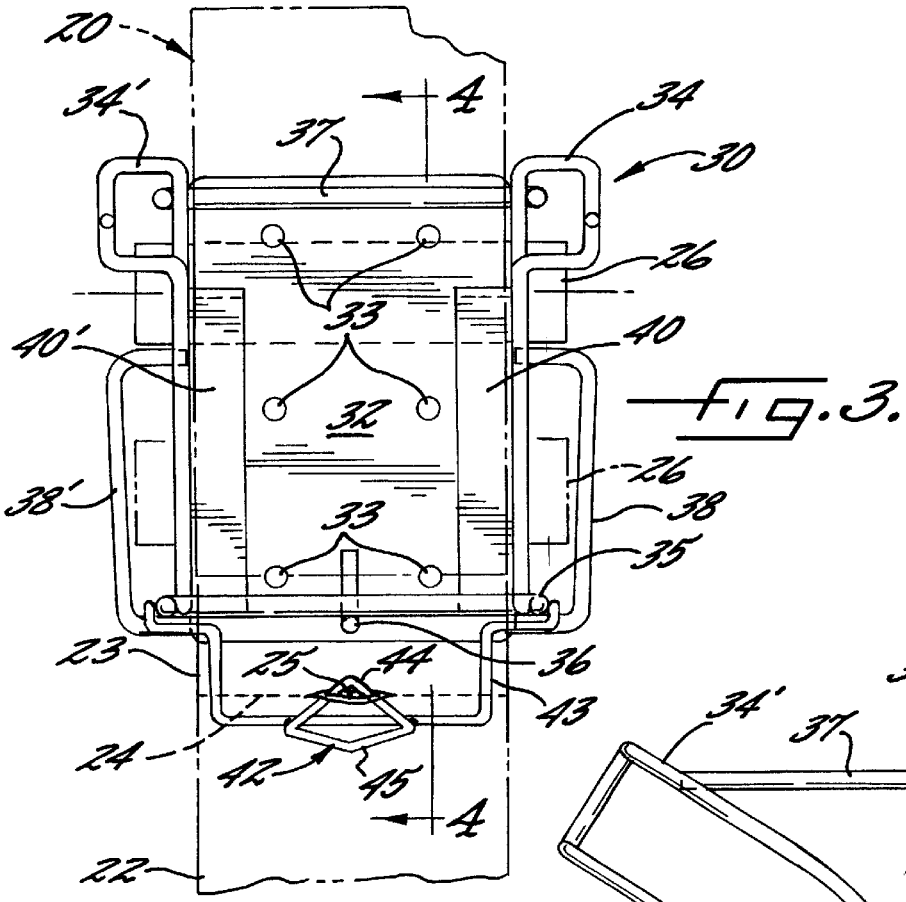
FIG. 3 is a front view of the bag dispenser with a full roll of bags in phantom and a partial roll of bags in phantom.
Figure 4:
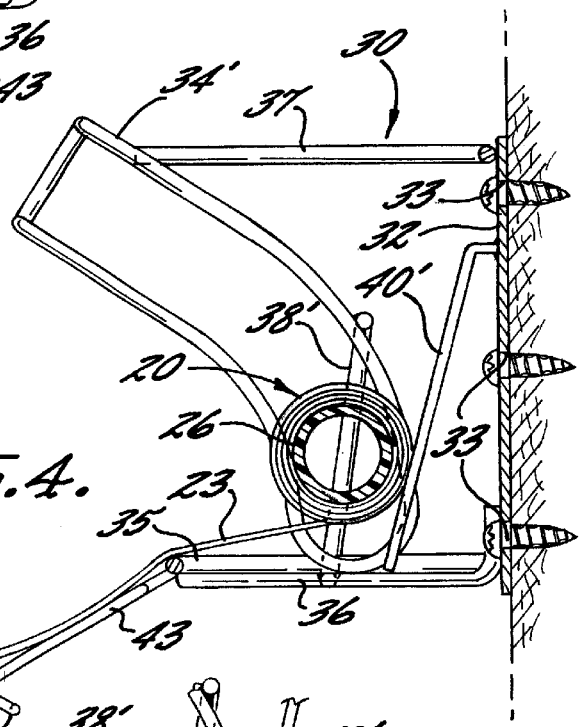
FIG. 4 is a cross-sectional view of the bag dispenser along lines 4—4 of FIG. 3 illustrating a nearly empty roll of bags.
Figure 5:
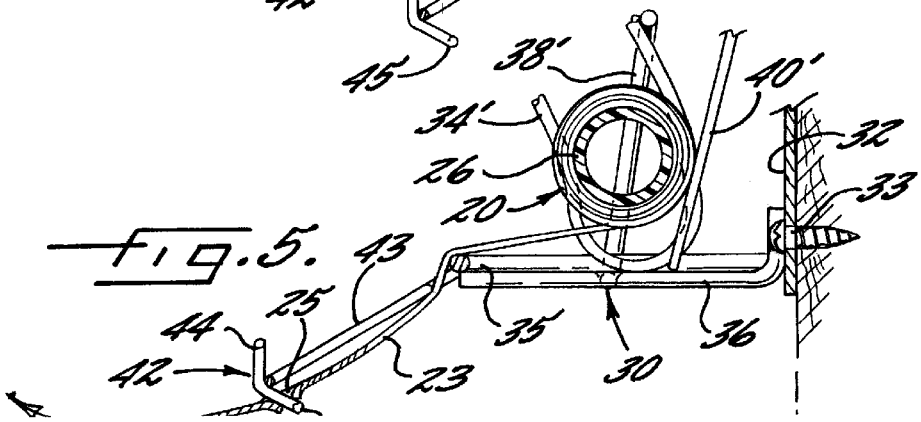
FIG. 5 is a partial side view of the bag dispenser with a nearly empty roll of bags with the roll of bags being held under tension by the brake and with a bag being pulled upwardly under the separating tongue.

In a preferred embodiment, tensioning member, brakes 40, 40' are attached to support member 32. As best seen in FIG. 3, brakes 40, 40' are attached to support member 32 so that they are positioned perpendicular to core 26. As shown most clearly in FIGS. 4 and 5, the brakes 40, 40' are two metal plates or bars, preferably disposed at an angle to support member 32 to provide tension against the outer edges of the roll of bags as the bags are removed from the roll and the core passes through the channel passageway toward the closed end. The brakes 40, 40' are spaced apart such a distance that only the outer edges of the circumference of the roll of bags are in contact with each brake plate. By applying tension only at the edges of the roll any printing or indicia on the bags does not come in contact with the dispenser. Brakes 40, 40' support the weight of the roll of bags 20 so that as a bag is being dispensed, the weight of the roll of bags 20 against brakes 40, 40' acts to retard the dispensing of the roll of bags 20.

During dispensing, a central portion of the bag 22 being dispensed passes between spaced-apart brakes 40, 40'. In this manner, ink from printing or indicia on this central portion of bags 20 can pass between spaced-apart brakes 40, 40', thereby avoiding contact with the dispenser. It is advantageous to keep ink from contacting the dispenser, in order to avoid the transfer of ink from bags 20 to the dispenser. Transfer of ink to the dispenser produces an undesirable staining of the dispenser. Prior art dispensers having a brake which extends across the entire width of the bag roll have become quite stained due to ink transferring from bags 20 to the dispenser. A stained dispenser appears dirty to consumers. This is especially undesirable if the bags are being used for packaging fruits, vegetables, and other produce. This problem has been addressed by providing a dispensing system in accordance with my invention, i.e., having brakes which contact only the outer edges of the circumference of the roll of plastic bags.

Brakes 40, 40' act to apply a tension to first bag 22 and next bag 23. When the roll is full, the roll of bags 20 has enough weight to pinch next bag 23 between roll of bags 20 and brakes 40, 40' so that a sufficient amount of tension is provided for tongue 42 to deflect. When the amount of bags in roll of bags 20 decreases, the amount of tension created by the weight of the roll of bags 20 decreases as well. Therefore, when there are fewer bags in roll of bags 20, the retardation provided by brakes 40, 40' act to maintain a level of tension sufficient for tongue 42 to deflect. Additionally, by retarding the rotation and dispensing of the roll of bags 20, brakes 40, 40' prohibit the roll of bags 20 from unraveling uncontrollably In an alternative embodiment, outer bar members 38, 38' form a part of each channel. The core retaining members 38, 38' are preferably bars attached to the outerside of each channel 34, 34' toward their closed ends and are positioned so that they contact the ends of the core. As shown, the core retaining members 38, 38' extend upwardly from the base of the closed end of the channel where the channel is attached to wire bracket 35 across the width of the channel where each member attaches to the upper side of its respective channel. Channels 34, 34' have an open end for receiving a full roll of bags 20 that is slightly wider than the other end (closed end) of the channel, as noted in FIG. 3. As the roll of bags decreases in size, the core 26 passes through the channels 34, 34' toward the closed ends and in doing so, the ends of the core 26 contact outer bar members 38, 38'. The outer bar members 38, 38' serve to keep the core within the channels and not pop out as the diameter of the roll of bags gets smaller, and serves to retard the rotation of the roll of bags as the roll diminishes in diameter so that the roll does not unravel if pulled too hard. which serve to retard rotation of the core. The channels 34, 34' and other frame members are constructed from metallic wire, such as stainless steel or chrome plated wire. These wires are aesthetically pleasing and also easy to clean, a requirement in the food industry.

The dispenser 30 is provided with a tongue 42 spaced apart from and carried by the support member 32 in a predetermined position corresponding to the predetermined position of slot 25 in the tear line 24 separating the bags on roll 20. Tongue 42 may be constructed of metallic wire. The tongue 42 is attached to wire bracket 43, the ends of which are in turn attached to the outer sides of bracket 35. The wire of bracket 43 is preferably of such size that it deflects as a bag is removed from the roll. Bracket 43 extends downward away from bracket 35. Tongue 42 has a top 44 and a bottom 45 and is preferably a diamond shaped wire attached to bracket 43 at its midsection. (Best seen in FIGS. 4 and 5). Tongue 42 is dimensioned so that as first bag 22 is pulled across tongue 42, slot 25 engages it. Tongue 42 has top 44 and bottom 45 so that first bag 22 may be pulled either across top 44 of tongue 42 or across bottom 45 of tongue 42 and still have top 44 or bottom 45 engage slot 25, respectively. Tongue 42 is preferably bent inwardly from its attachment point, so that top 44 and bottom 45 each form an acute angle between bracket 43 and itself. Furthermore, to accommodate the variety of orientations for bag dispenser 30, bracket 43 may be angled differently to better allow slot 25 to engage tongue 42. Therefore, bag dispenser 30 may be mounted vertically, horizontally, or in another position by simply changing the angle of tongue 42, which may be done by interchanging tongue 42 with a different one or by bending tongue 42 to the desired angle.

In operation, a user takes first bag 22 in hand and pulls it either over or under tongue 42 creating a tension in first bag 22 and next bag 23. The tension created in the bags causes the tongue 42 and bracket 43 to deflect up or down depending on the orientation of the bags as shown by the arrows in FIG. 2 and FIG. 5. The user continues to pull first bag 22 until tongue 42 snaps into slot 25, thus stopping next bag 23 and facilitating the tearing of first bag 22 along perforation line 24 as tongue 42 recoils from its deflected position to its normal position. The addition of the recoil force applied by tongue 42 helps to separate the two bags and decreases the amount of force the user must apply. Additionally, the application of the recoil force from tongue 42 on next bag 23 will lift the next bag so that it will be easy to grab by the next user.

It will be apparent to those skilled in the art that many modifications and substitutions can be made to the foregoing preferred embodiment without departing from the spirit and scope of the present invention, which is defined by the appended claims.

That which is claimed is:

1. A bag dispensing system comprising:

a roll of individual interconnected plastic bags rolled onto a core, said individual bags being interconnected by a perforated tear line including a slot located in a predetermined position within said tear line for separating said bags, said bags having printing thereon; and a dispenser comprising:

a support member for attachment to a support surface;

a pair of arcuate guide channels carried by said support member for rotatably supporting said roll of plastic bags for rotation of the roll on said core and each of arcuate guide channels having an open end for receiving said core and a closed end;

a pair of brakes attached to said support member and disposed at an angle thereto to retard rotation of said roll, the pair of brakes contacting only outer edges of an outer curved surface of the roll of plastic bags, the outer curved surface of the roll of bags contacting only the pair of brakes during dispensing in order to substantially prevent ink transfer from the bags to the dispenser, the pair of brakes being in a fixed position relative to the support member, and the pair of brakes supports the weight of the roll of bags; and a tongue spaced apart from and carried by said support member in a predetermined position corresponding to the predetermined position of said slot in said tear line.

2. The bag dispensing system according to claim 1 wherein said pair of brakes are a pair of narrow brake plates.

3. The bag dispensing system according to claim 1 wherein said arcuate channels are spaced wider apart from each other at said open ends than at said closed ends.

4. The bag dispensing system according to claim 1 wherein said pair of arcuate channels further comprises core retaining members for maintaining said core within said arcuate channels as the roll diminishes in diameter.

5. The bag dispensing system according to claim 1 wherein said tongue has a top engaging portion and a bottom engaging portion, whereby either of said engaging portions engages said slot in said tear line regardless of whether said bags are brought over said top portion of said tongue or over said bottom portion of said tongue.

6. The bag dispensing system according to claim 1 wherein said tongue has a top engaging portion and a bottom engaging portion, wherein said top and bottom tongue engaging portions further comprise a symmetrical wire, diamond shaped and acutely angled toward said roll of bags.

7. A bag dispensing system comprising:

a roll of individual interconnected plastic bags rolled onto a core, said individual bags being interconnected by a perforated tear line including a slot located in a predetermined position within said tear line for separating said bags, said bags having printing thereon; and a dispenser comprising:

a support member for attachment to a support surface;

a pair of arcuate guide channels carried by said support member formed from metal rods for rotatably supporting said roll of plastic bags for rotation of the roll on said core and having open ends for receiving said core and closed ends, said open ends being wider apart from each other at said open ends than at said closed ends, said pair of arcuate channels further comprising core retaining members for maintaining said core within said channels as said roll diminishes in diameter, retarding rotation of said core;

a pair of brakes attached to said support member and disposed at an angle thereto to retard rotation of said roll, the pair of brakes contacting only outer edges of an outer curved surface of the roll of plastic bags, the outer curved surface of the roll of bags contacting only the pair or brakes during dispensing in order to substantially prevent ink transfer from the bags to the dispenser, the pair of brakes being in a fixed position relative to the support member, and the pair of brakes supports the weight of the roll of bags; and a tongue spaced apart from and carried by said support member in a predetermined position corresponding to the predetermined position of the slot in said tear line, said tongue having a top and bottom to engage said slot in said tear line regardless of whether said bags are brought over said top of said tongue or over said bottom of said tongue, said tongue being acutely angled toward said roll of bags.

8. A dispenser for dispensing bags from a roll of plastic bags rolled onto a core, each bag of said roll being separated by a perforated tear line including a slot located in a predetermined position within said tear line, said bags having printing thereon, comprising:

a support member for attachment to a support surface;

a pair of guide channels carried by said support member for rotatably supporting said roll of plastic bags for rotation of the roll on said core and each of said guide channels having an open end for receiving said core and a closed end;

a pair of brakes attached to said support member to retard rotation of said roll, the pair of brakes being positioned for contact with only outer edges of an outer curved surface of the roll of plastic bags, the outer curved surface of the roll of bags contacting only the pair of brakes during dispensing in order to substantially prevent ink transfer from the bags to the dispenser, the pair of brakes being in a fixed position relative to the support member, and the pair of brakes supports the weight of the roll of bags; and a tongue spaced apart from and carried by said support member in a predetermined position corresponding to the predetermined position of the slot in said tear line.

9. The dispenser according to claim 8 wherein said pair of guide channels are wider at the open ends of said channels than at the closed ends of said channels.

10. The dispenser according to claim 8 wherein said brakes are a pair of narrow brake plates.

11. The dispenser according to claim 8 wherein said pair of guide channels further comprises core retaining members for maintaining said core within said pair of guide channels as said roll diminishes in diameter.

12. The dispenser according to claim 8 wherein said tongue has a top engaging portion and a bottom engaging portion, whereby either of said engaging portions engages said slot in said tear line regardless of whether said bags are brought over said top portion of said tongue or over said bottom portion of said tongue.

13. The dispenser according to claim 8 wherein said tongue further comprises a symmetrical wire, diamond shaped, and acutely angled toward said roll of bags.

14. A dispenser for dispensing bags from a roll of plastic bags rolled onto a core, each bag of said roll being separated by a perforated tear line including a slot located in a predetermined position within said tear line, said bags having printing thereon, comprising:

a support member for attachment to a support surface;

a pair of arcuate guide channels carried by said support member formed from metal rods for rotatably supporting said roll of plastic bags for rotation of the roll on said core and each of said arcuate guide channels having an open end for receiving said core and a closed end, said open ends being wider apart from each other at said open ends than at said closed ends;

a pair of brakes attached to said support member and disposed at an angle thereto to retard rotation of said roll, the pair of brakes being positioned to contact only outer edges of an outer curved surface of the roll of plastic bags, the dispenser being designed so that the outer curved ,surface of the roll of bags contacts only the pair of brakes during dispensing in order to substantially prevent ink transfer from the bags to the dispenser, the pair of brakes being in a fixed position relative to the support member, and the pair of brakes supports the weight of the roll of bags; and a tongue spaced apart from and carried by said support member in a predetermined position corresponding to the predetermined position of the slot in said tear line, said tongue having a symmetrical diamond shaped top and bottom to engage said slot in said tear line regardless of whether said bags are brought over said top of said tongue or over said bottom of said tongue.

15. A bag dispensing system comprising:

(A) a roll of individual interconnected plastic bags rolled onto a core, the individual bags being interconnected by a perforated tear line including a slot located in a predetermined position within the tear line for separating the bags, the bags having printing thereon; and (B) a dispenser comprising:

(i) a support member for attachment to a support surface;

(ii) a pair of guide channels carried by the support member for rotatably supporting the roll of plastic bags for rotation of the roll on the core, each guide channel having an open end for receiving the core;

(iii) a pair of brakes to retard rotation of the roll, the pair of brakes positioned to contact only outer edges of an outer curved surface of the roll of plastic bags, the dispenser being designed so that the outer curved surface of the roll of bags contacts only the pair of brakes during dispensing in order to substantially prevent ink transfer from the bags to the dispenser, the pair of brakes being in a fixed position relative to the support member, and the pair of brakes supports the weight of the roll of bags; and (iv) a tongue spaced apart from and carried by the support member in a predetermined position corresponding to the predetermined position of the slot in the tear line.

16. The dispensing system according to claim 15, further comprising core retaining members for maintaining the core within the channels as the roll diminishes in diameter, the core retaining members serving to retard rotation of the roll.

17. The dispensing system according to claim 15, wherein the guide channels are arcuate.

18. The dispensing system according to claim 15, wherein the pair of brakes are positioned perpendicular to the core.

19. The dispensing system according to claim 15, wherein the pair of brakes are spaced apart so that only the outer edges of the circumference of the roll of bags are in contact with the pair of brakes.

20. The dispensing system according to claim 15, wherein the brakes are a pair of brake plates.

21. The dispensing system according to claim 15, wherein the pair of brakes comprises two metal plates.

22. The dispensing system according to claim 15, wherein the pair of brakes is attached to the support member and disposed at an angle thereto.

* * * * *